US009074846B2

(12) United States Patent
Mencotti

(10) Patent No.: US 9,074,846 B2
(45) Date of Patent: Jul. 7, 2015

(54) SCOPE CAP

(71) Applicant: MAG Security Consultants, Inc., Commerce Township, MI (US)

(72) Inventor: Marcus Decio Mencotti, Commerce Township, MI (US)

(73) Assignee: MAG Security Consultants, Inc., Commerce Township, MI (US)

( * ) Notice: Subject to any disclaimer, the term of this patent is extended or adjusted under 35 U.S.C. 154(b) by 0 days.

(21) Appl. No.: 13/943,182

(22) Filed: Jul. 16, 2013

(65) Prior Publication Data

US 2015/0021394 A1 Jan. 22, 2015

(51) Int. Cl.

| | |
|---|---|
| ***G06F 19/00*** | (2011.01) |
| ***G06G 7/80*** | (2006.01) |
| ***F41G 3/06*** | (2006.01) |
| ***F41G 11/00*** | (2006.01) |

(52) U.S. Cl.

CPC . *F41G 3/06* (2013.01); *F41G 11/00* (2013.01)

(58) Field of Classification Search

CPC ..... F41G 1/38; F41G 3/08; F41G 1/473; F41G 3/06; F41G 3/065; F41G 1/02; F41G 1/467; F41G 3/00; F41G 3/12; F41G 3/142; F41G 3/147; F41G 3/2627; F41G 3/2644; F41G 1/1632; F41A 33/02; F41A 17/54

USPC ..... 235/400–408

See application file for complete search history.

(56) References Cited

U.S. PATENT DOCUMENTS

| | | | | |
|---|---|---|---|---|
| 3,552,053 | A | 1/1971 | Jarvis | |
| 5,299,067 | A * | 3/1994 | Kutz et al. | 359/827 |
| 5,375,072 | A * | 12/1994 | Cohen | 702/94 |
| 5,546,691 | A | 8/1996 | Allison | |
| 6,252,706 | B1 * | 6/2001 | Kaladgew | 359/399 |
| 6,269,581 | B1 * | 8/2001 | Groh | 42/122 |
| 7,421,816 | B2 | 9/2008 | Conescu | |
| 7,624,528 | B1 | 12/2009 | Bell et al. | |
| 7,647,721 | B1 * | 1/2010 | Gaber et al. | 42/129 |
| 7,797,873 | B2 | 9/2010 | Gering et al. | |
| 8,571,398 | B1 * | 10/2013 | Goddard et al. | 396/25 |
| 2007/0277421 | A1 * | 12/2007 | Perkins et al. | 42/122 |
| 2011/0168777 | A1 | 7/2011 | Bay | |
| 2011/0249335 | A1 * | 10/2011 | Strawderman et al. | 359/511 |

(Continued)

FOREIGN PATENT DOCUMENTS

CN 102538599 A * 7/2012 ..... F42B 39/00

OTHER PUBLICATIONS

Pikielny, Dov, Shot Counter, U.S. Appl. No. 11/559,956, filed Nov. 15, 2006, 8 pages.

(Continued)

*Primary Examiner* — Tuyen K Vo

(74) *Attorney, Agent, or Firm* — Dickinson Wright PLLC

(57) ABSTRACT

A scope cap includes memory storage for recording and recalling bullet drop compensation data and a visual display. A protective lid pivotably attaches to the scope cap by a hinge to protect the scope cap. The protective lid includes a flange to manually pivot the protective lid about the hinge. The scope cap is mounted to a scope of cylindrical shape; the scope cap is circular in shape to slidably attach over the cylindrical shape of the scope. The scope cap presents an opening which surrounds an ocular lens for viewing a selected target. The scope cap defines a top having a first protrusion and a bottom having a second protrusion. The first protrusion includes a set of scroll keys, a power button, and a backlight button. The second protrusion includes an input button and a gun button.

20 Claims, 3 Drawing Sheets

(56) References Cited

U.S. PATENT DOCUMENTS

| | | | | |
|---|---|---|---|---|
| 2012/0144720 | A1* | 6/2012 | Lacorte | 42/130 |
| 2012/0297658 | A1* | 11/2012 | Lupher et al. | 42/69.01 |
| 2012/0298750 | A1* | 11/2012 | McCarty et al. | 235/404 |
| 2014/0110483 | A1* | 4/2014 | Benson | 235/404 |

OTHER PUBLICATIONS

Clark, Robert Bernard Iredale, et al., Device for Recording and Displaying Data from the Firing of Small-Arms, U.S. Appl. No. 11/746,711, filed May 10, 2007, 16 pages.

Ufer, Robert, et al., Self calibrating weapon shot counter, U.S. Appl. No. 13/066,105, filed Apr. 6, 2011, 55 pages.

Digital Shot Counter, available at http://www.liveleak.com/view?i=d3f_1296170711&comments=1, last viewed Sep. 13, 2013.

Barrett Optical Ranging System (BORS), available at http://barrett.net/optics/bors, last viewed Sep. 13, 2013.

Bay, Laurence Andrew, System and method for ballistic solutions, U.S. Appl. No. 12/879,277, filed Sep. 10, 2010, 50 pages.

McRae, Michael William, Firearm system for data acquisition and control, U.S. Appl. No. 11/801,113, filed May 7, 2007, 23 pages.

* cited by examiner

SCOPE CAP

CROSS REFERENCE TO RELATED APPLICATION

None

BACKGROUND OF THE INVENTION

1. Field of the Invention

This invention relates to a device for recording and recalling bullet drop compensation data to a shooter for a firearm having a barrel axis.

2. Description of the Prior Art

Bullet drop compensation data refers to the elevation adjustment required between the angle of the barrel axis and a central axis of a scope to accurately place a discharged bullet on the correct trajectory to hit an intended target. The elevation adjustment depends on the distance from the shooter to the intended target, the further the distance between the shooter and the intended target the greater the angle adjustment that may be required. The shooter must determine the bullet drop compensation data for incremental distances and record the bullet drop compensation data for use at a later time.

To use the bullet drop compensation data at a later time, many shooters carry a written record of the bullet drop compensation data on their person or affix the written record to the stock of their firearm. Additionally, as can be seen in U.S. patent application Ser. No. 12/879,277, memory storage may be used for storing bullet drop compensation data and displaying the bullet drop compensation data to the shooter on a visual display mounted on a rail system on the side of a firearm. Unfortunately, present systems for storing the bullet drop compensation data, such as the system disclosed in the above application, are very bulky, do not conveniently display the required information, and may also alter the delicate weight balance of the firearm.

SUMMARY OF THE INVENTION

The invention provides a device for supporting the memory storage and the visual display on a scope cap. The scope cap, supporting the memory storage and visual display, may then be mounted to a scope on a firearm such that a shooter may look through the scope cap and through the scope to acquire a target. The memory storage communicates with the visual display to recall bullet drop compensation data and present the bullet drop compensation data to the shooter.

ADVANTAGES OF THE INVENTION

Advantages of the present invention include a device to record and recall bullet drop compensation data to the shooter in a convenient and light weight package placed directly in front of the eye of the shooter. Additionally, due to the placement of the scope cap over the scope, the scope cap will not alter the weight balance of the firearm. Other advantages of the present invention should be readily apparent from the following Figures and description.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Referring to the Figures, wherein like numerals indicate corresponding parts throughout the several views, a device comprising a scope cap 20 is illustrated for recording and recalling bullet drop compensation data to a shooter for a firearm 10 having a barrel axis $A_1$.

Figure 1:
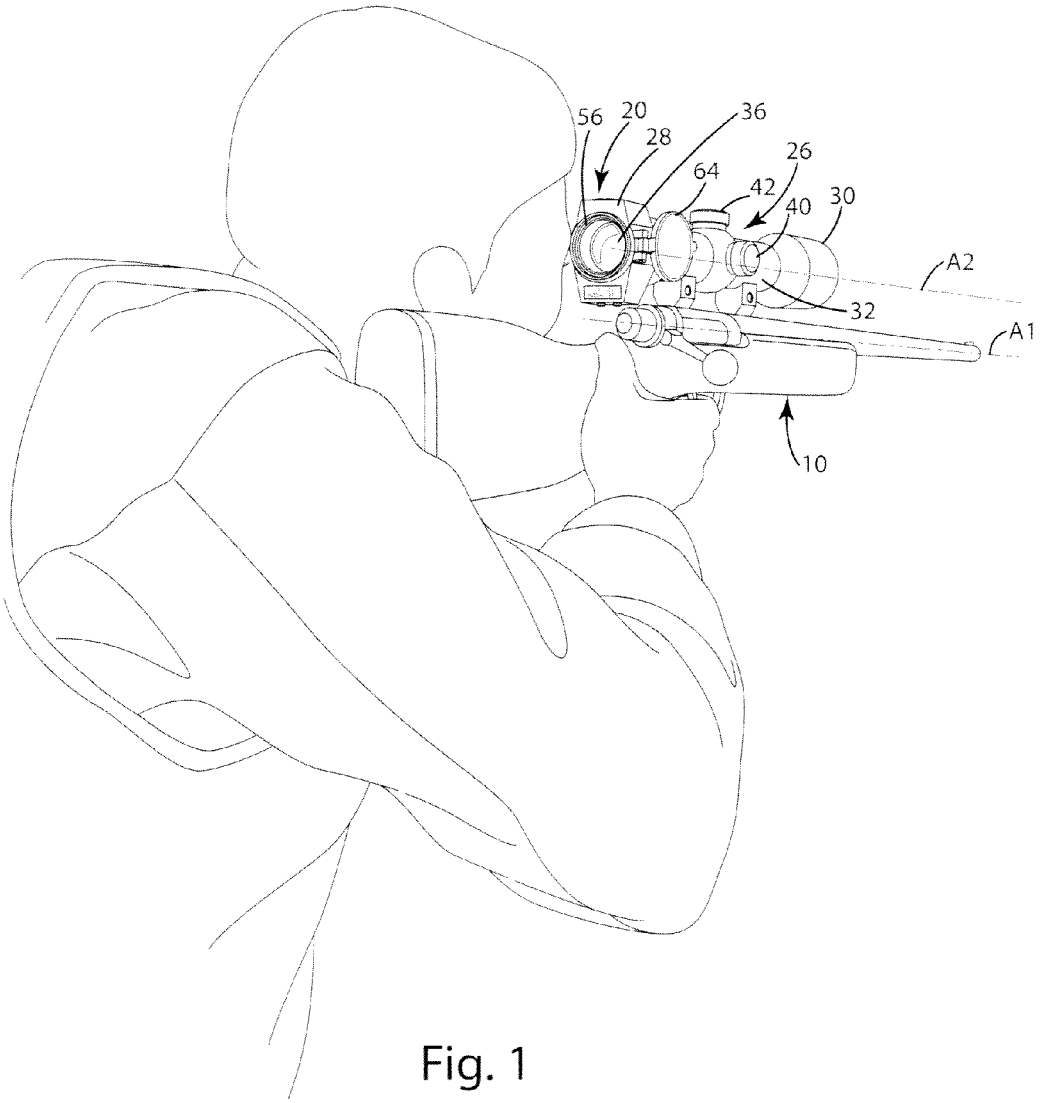
FIG. 1 is a perspective view showing the scope cap of the present invention attached to a scope in use by a shooter.

Referring to FIG. 1, which shows the scope cap 20 in use by the shooter, the scope cap 20 contains a visual display 22 and memory storage 24 for recording and recalling bullet drop compensation data and is mounted to a scope 26 of cylindrical shape, but may include other cylindrical or circular shapes. The scope 26 may be disposed about a central axis $A_2$ and extend between a first end 28 and a second end 30. Additionally, the scope 26 may present an outer wall 32 and an inner wall. To assist the shooter in acquiring a selected target, the scope 26 may contain two or more lenses designed to collect and magnify light for the shooter. An ocular lens 36 being circular in shape and concentric with the central axis $A_2$ may be disposed in the first end 28 of the scope 26. An objective lens being circular in shape and concentric with the central axis $A_2$ may be disposed in the second end 30 of the scope 26. The objective lens may transmit light surrounding the scope 26 into the scope 26 and the ocular lens 36 may then magnify the light. The transmission and magnification of light assists the shooter in viewing a selected target at long distances when the shooter is looking into the first end 28 of the scope 26.

The scope 26 may also have a means of adjusting the angles, both vertically and horizontally, between the central axis $A_2$ and the barrel axis $A_1$. The shooter may desire to adjust the vertical and/or horizontal angles in response to external conditions which may affect the trajectory of the bullet. Such external conditions may take a variety of forms including, but not limited to, distance between the target and the shooter, elevation differences between the shooter and the target, wind speed and wind direction, precipitation, barometric pressure, and humidity. To adjust the vertical angle between the firearm barrel and the central axis $A_2$, the scope 26 may come equipped with an elevation adjustment 40 on the outer wall 32 of the scope 26. To adjust the horizontal angle between the firearm barrel and the central axis $A_2$, the scope 26 may come equipped with a windage adjustment 42 on the outer wall 32 of the scope 26. The elevation adjustment 40 and the windage adjustment 42 can be seen in FIG. 1.

Figure 5:
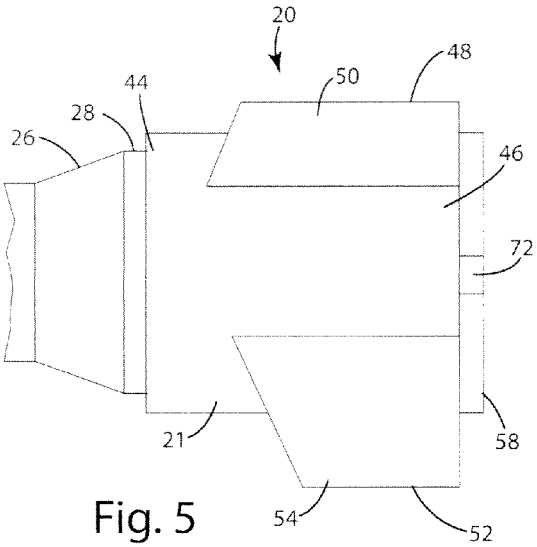
FIG. 5 is a side view of the scope cap.
Figure 6:
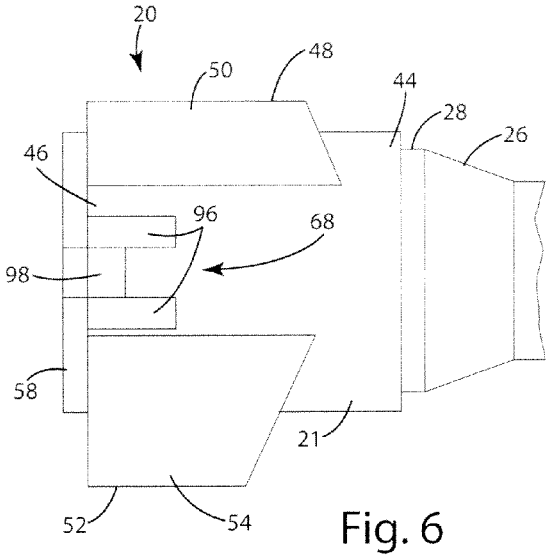
FIG. 6 is a side view of the scope cap showing the hinge for the protective lid.
Figure 7:
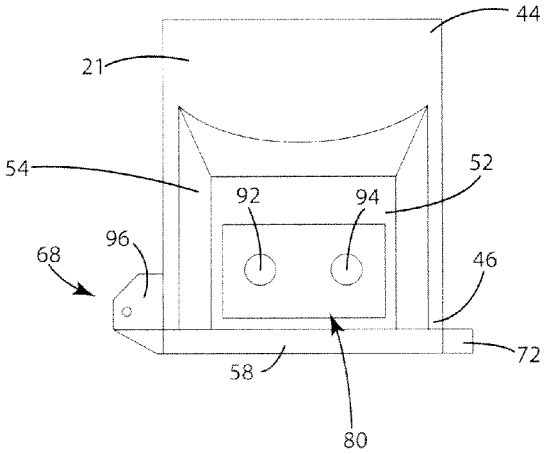
FIG. 7 is a bottom view of the scope cap.

The scope cap 20 may include a generally cylindrical shaped body portion 21 which extends between a mounting end 44 and a visual end 46. Additionally, the scope cap 20 may present an opening which surrounds the ocular lens 36 for viewing the selected target. In a preferred embodiment, the mounting end 44 of the scope cap 20 may be circular in shape to slidably attach over the cylindrical shape of the first end 28 of the scope 26, thereby engaging the scope 26 as a sleeve mount, as shown in FIG. 5. However, other mounting means may be utilized to obtain to the same results, for example a ring mount, a clamp, or a bracket may be used to affix the scope cap 20 to the first end 28 of the scope 26.

Figure 2:
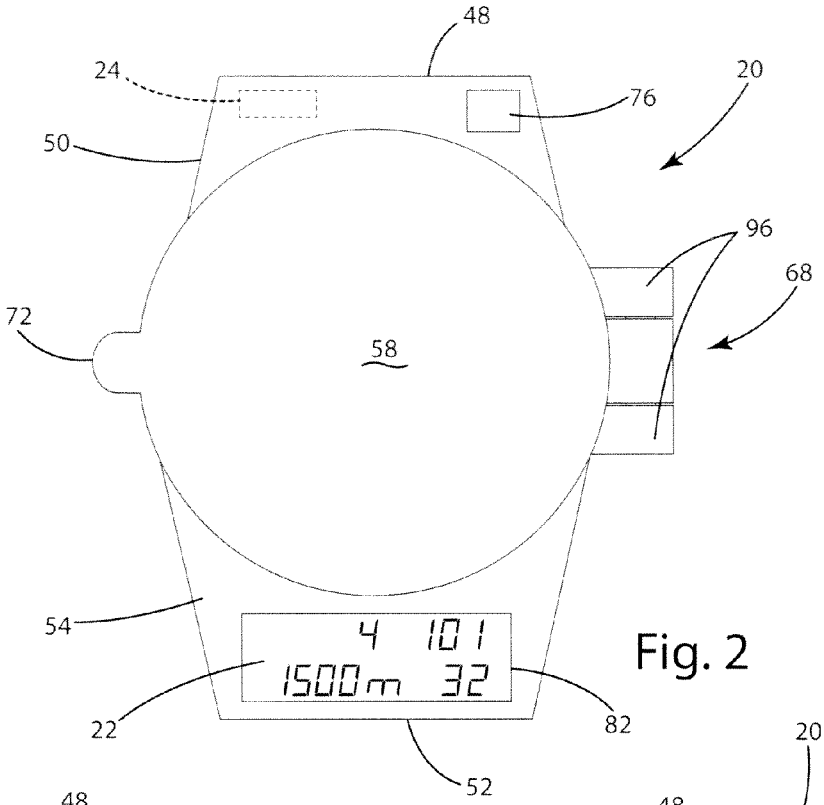
FIG. 2 is an end view of the scope cap with the protective lid in the closed position illustrating the visual display.
Figure 3:
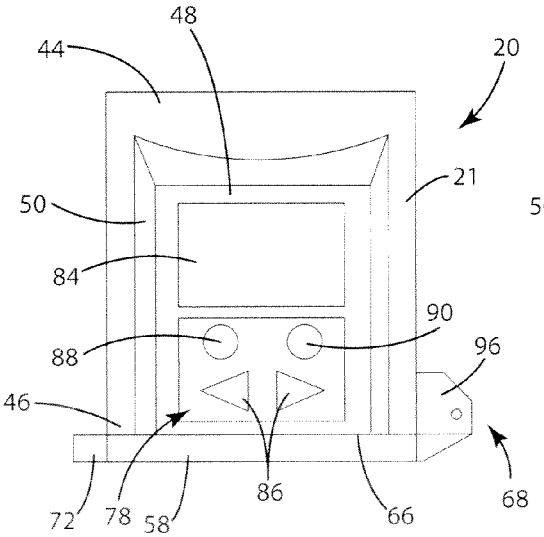
FIG. 3 is a top view of the scope cap with the protective lid in the closed position.
Figure 4:
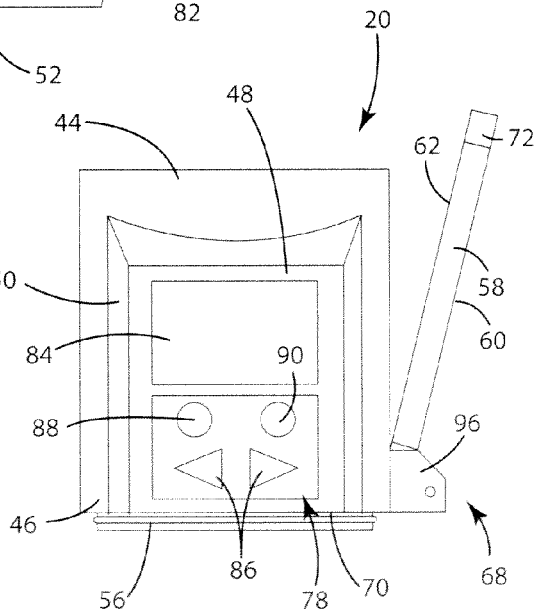
FIG. 4 is a top view of the scope cap with the protective lid in the open position.

The mounting end 44 of the scope cap 20 may be made in various sizes to accommodate different sizes and styles of scopes 26. Additionally, while the mounting end 44 is preferably circular in shape to slide over the first end 28 of the scope 26, other shapes may be employed for mounting the scope cap 20 to the scope 26. Additional shapes for the mounting end 44 may include, but are not limited to, square, rectangular, triangularly, polygonal, or oval. These additional shapes, or any other shape, may work so long as the mounting end 44 of the scope cap 20 can circumscribe the outside or the inside of the cylindrical shape of the first end 28 of the scope 26. As shown in FIG. 2, the visual end 46 of the scope cap 20 may preferably have a cylindrical shape. The visual end 46 of the scope cap 20 may also be produced using alternative shapes, such as, for example, the additional shapes discussed above for the mounting end 44 of the scope cap 20.

The visual end 46 of the scope cap 20 may define an upper or top portion 48 presenting a first protrusion 50 extending radially and outwardly from the body portion 21 of the scope cap 20 and a lower or bottom portion 52 presenting a second protrusion 54 extending radially and outwardly from the body portion 21 of the scope cap 20. The visual end 46 of the scope cap 20 may additionally define a lip 56 of circular shape which may extend annularly about and axially from the visual end 46 of the scope cap 20.

A preferred embodiment of the invention may include a protective lid 58 for use in association with the scope cap 20. The protective lid 58 has an interior side 60 and an exterior side 62. The interior side 60 of the protective lid 58 may define a groove 64 of circular shape for receiving and engaging the annular lip 56 of the scope cap 20, thereby retaining the protective lid 58 against the visual end 46 of the scope cap 20 in a closed position 66. The lip 56 and groove 64 retention system between the scope cap 20 and the protective lid 58 may be any other retention system which may restrain movement of the protective lid 58 from the closed position 66. The alternative retention system may include, but is not limited to, friction retention, latch retention, hinge retention, or pin retention. It should be noted that the lip 56 and/or the groove 64 may include a gasket seal made from an organic polymeric material. Inclusion of the gasket may increase the durability of the scope cap 20 by preventing, sand, and other foreign objects from entering the visual end of the scope cap 20 if the scope cap 20 is deployed in hostile conditions, such as a desert, or submerged in water. Additionally, the scope cap 20 and the protective lid 58 may still operate without the inclusion of a retention system between the scope cap 20 and the protective lid 58. The combination of the scope cap 20 and the protective lid 58 may be referred to as a scope cap assembly.

The exterior side 62 of the protective lid 58 may be made of a durable material for shielding the ocular lens 36. Such durable material may preferably be an elastomeric material. The protective lid 58 may additionally be made from any organic polymeric material, such as a rubber or a plastic, or a metal, such as steel or aluminum. It should be noted that the above mentioned materials are examples of the material the protective lid 58 may be made from and should not be considered limiting. The durable material may add little weight to the overall low weight of the scope cap 20.

The protective lid 58 is connected to the visual end 46 of the scope cap 20. In a preferred embodiment, the protective lid 58 is pivotably attached to the scope cap 20. Pivotably attaching the protective lid 58 to the scope cap 20 may allow for pivotal movement of the protective lid 58 between the closed position 66 wherein the opening is covered and ocular lens 36 is protected and an open position 70 for exposing the ocular lens 36. A hinge unit 68 may preferably be used to pivotably attach the protective lid 58 to the scope cap 20. The hinge unit 68 may include a pair of laterally spaced hubs 96 extending from the body portion 21 of the scope cap 20 and a hinge tab 98 extending from the protective lid 58. Additionally the hinge unit 68 may be spring loaded to alternatively hold the scope cap 20 in the closed position 66 for protecting the ocular lens 36 and holding the scope cap 20 in the open position 70 to expose the ocular lens 36. An over-center spring disposed between the hinge tab 98 and the hubs 96 may be used to provide the two distinct positions of the protective lid 58 relative to the scope cap 20.

A flange 72 may protrude radially from the protective lid 58. The shooter may apply a manual force against the flange 72 to execute the pivotal movement of the protective lid 58 between the open position 70 and the closed position 66. Additionally, an automatic release mechanism may be used to pivot the protective lid 58 from the closed position 66 to the open position 70 automatically. To utilize the automatic release mechanism, the spring within the spring loaded hinge unit 68 may be compressed by the shooter manually to pivot the protective lid 58 to the closed position 66. When the protective lid 58 is in the closed position 66, a retention mechanism may hold the lid in the closed position 66 and retain the energy stored in the compressed spring. The retention mechanism may preferably include a latch; however, any retention mechanism capable of retaining the protective lid 58 in the closed position 66 may be used. A release button disposed on the scope cap 20 may be depressed to release the latch of the retention mechanism, causing the spring within the hinge unit 68 to release and auto a ca pivot the protective lid 58 from the closed position 66 to the open position 70.

The individual components of the scope cap 20 described above may be produced from a durable material, such as an elastomeric or organic polymeric material. Additionally, all or a portion of the scope cap 20 components described above may be produced from a metal, such as a steel, aluminum, or tungsten. The scope cap 20 may be deployed in harsh or hostile environments producing extremely high temperatures, such as a desert, extremely low temperatures, such as a snow covered mountain, extreme humidity, such as a swamp, or extreme pressure forces and/or flying debris, such as an active war zone. Additionally, the shooter may be required to submerse the scope cap 20 underwater. Utilizing durable materials for the construction of the scope cap 20, such as an organic polymeric material, may provide greater protection for the ocular lens 36 of the scope 26, the visual end 46 of the scope cap 20, and the individual components described above in the event the shooter utilizes the scope cap in a harsh or hostile environment.

As illustrated in FIG. 2, the disclosed invention may also include the memory storage 24 as briefly discussed above. The memory storage may store the bullet drop compensation data. Additionally, the memory storage 24 may be supported by the scope cap 20 to create a light weight and convenient package for mounting to the scope 26. The bullet drop compensation data establishes the vertical angle between the central axis $A_2$ and the barrel axis $A_1$ for each incremental distance to a selected target. It should be recognized that the memory storage 24 may also be part of a central processing unit (CPU), a data processing system (DPS), or any other processor for computing, processing, and/or storing bullet drop compensation data.

In a preferred embodiment, the scope cap 20 may have a plurality of memory storage 24 partitions, preferably five partitions, for storing gun data for multiple firearms. While the preferred embodiment utilizes five partitions, it should be recognized that any number of memory partitions, or only one single memory storage 24, may be used for storing gun data and bullet drop compensation data. Additionally, it should be noted that gun data may include data for a plurality of different firearms, different ammunitions, or any other variable the shooter chooses to store.

The scope cap 20 may be interchangeable between the plurality of different firearms and therefore the memory storage 24 may store bullet drop compensation data for each of the plurality of different firearms, representing different gun data within the plurality of memory storage 24 partitions. For example, if the shooter utilizes all five of the memory storage 24 partitions, a first memory partition may store bullet drop compensation data for a Winchester® 30-06 Springfield using 180 grain soft tip ammunition. A second memory partition may store bullet drop compensation data for a Browning® 0.308 using 150 grain hard tip ammunition. A third memory storage partition may store bullet drop compensation data for a Savage® 270 using 165 grain silver tip ammunition. A fourth memory storage 24 partition may store bullet drop compensation data for a Smith and Wesson® .44 caliber handgun using 265 grain jacketed hollow point ammunition. Finally, a fifth memory storage 24 partition may store bullet drop compensation data for a Ruger® 10/22 using grain 80 lead round nose ammunition. Once the data for the various firearms has been loaded into the memory storage 24 partitions, the shooter may then transfer the scope cap 20 between the various firearms to have accurate bullet drop compensation data in a single and transferrable digital mechanism.

The bullet drop compensation data for each of the plurality of memory storage 24 partitions may be stored in increments. In a preferred embodiment, the bullet drop compensation data may be stored in increments of meters. The memory storage 24 may additionally store the bullet drop compensation data in other increments, for example increments of yards. The memory storage 24 partitions may store the increments in any other distance units the shooter may choose. Displaying the bullet drop compensation data to the shooter for each increment is discussed in greater detail below.

As illustrated in FIG. 2, the scope cap 20 may additionally include a bullet count mechanism 76 supported by the scope cap 20. The bullet count mechanism 76 may be in communication with the memory storage 24 for counting the number of bullets discharged from the firearm to determine a bullet count number. In a preferred embodiment, the bullet count mechanism 76 may be a vibration sensor which communicates to the memory storage 24 that a bullet has been discharged upon sensing a vibration over a pre-determined vibration magnitude threshold. A pre-determined vibration magnitude threshold may aid the sensor to not register a shot has been fired if the firearm is accidently bumped, dropped, or is in the vicinity of another discharging firearm which may cause vibrations.

It should be recognized that alternative embodiments exist for the bullet count mechanism 76. Alternative embodiments may include, but are not limited to, an accelerometer or a microphone, or either an accelerometer or a microphone used in conjunction with the vibration sensor of the preferred embodiment or any other means of detecting the discharge of a firearm and communicating the information to memory storage 24. Additionally, the shooter may manually count the discharge of bullets from the firearm and manually upload this information to memory storage 24 through the use of hard keys, as discussed in greater detail below.

As illustrated in FIG. 2, a preferred embodiment may include the visual display 22 supported by the second protrusion 54 of the scope cap 20. However, the visual display 22 may alternatively be supported by the first protrusion 50. The visual display 22 may be responsive to the memory storage 24 and accessible by the shooter for displaying gun data and bullet count and distance to target and bullet drop compensation data. Additionally, other information may be displayed. Such information may include, but is not limited to, date, time, units of increment measurement, and any other information the shooter may desire to display. Additionally, as shown in FIG. 2, the visual display 22 may support a backlight 82 for illuminating the visual display 22.

In a preferred embodiment, as illustrated in FIG. 2, the visual display 22 may show the shooter which memory storage 24 partition is presently active, also known as gun data, as memory storage 24 partition '4'. The visual display 22 may show the distance increment measurement presently active, for example '1500 meters'. The visual display 22 may also show may show the bullet count, for example '101'. Finally, the visual display 22 may show the bullet drop compensation data, that is, the extent to which the shooter must adjust the vertical angle between the central axis $A_2$ and the barrel axis $A_1$ at the given distance increment measurement, for example '32' 'clicks'. Therefore, when the visual display 22 is configured as shown in FIG. 2, the shooter knows to adjust the angle between the central axis $A_2$ and barrel axis $A_1$ up '32' clicks or come-ups at '1500 meters'. Additionally, the shooter would know that this bullet drop compensation data is stored gun data for memory storage 24 partition '4' and the firearm has a bullet count of '101' bullets, meaning bullets have been discharged.

The first protrusion 50 of the scope cap 20 may support a power source 84 in communication with the memory storage 24 and the backlight 82. The power source 84 is preferably a solar panel charging a battery. However, the power source 84 may be a battery alone, a solar panel alone, or any other means of providing the power to the memory storage 24. The power source 84 may be located on anywhere on the scope cap 20; however, it is preferable to dispose the power source 84 on the first protrusion 50 of the scope cap 20. If the power source 84 is a solar panel or a solar panel charging a battery, it is advantageous to place the solar panel on the point of the scope cap 20 with the greatest exposure to the sun to maximize the solar energy received by the solar panel.

A first plurality of hard keys 78 may be disposed on the first protrusion 50 of the scope cap 20. The first plurality of hard keys 78 may include a set of scroll keys 86 for scrolling through the bullet drop compensation data, a backlight button 88 for controlling the backlight 82 and illuminating the visual display 22, and a power button 90 for controlling the power source 84. In an alternative embodiment, additional keys may be used, such as soft keys on a touch screen disposed on the visual display 22 or on a second visual display. Additionally, the first protrusion 50 may include other keys for controlling the memory storage 24, the visual display 22, or any other feature, such as the processor included in the alternative embodiment.

A second plurality of hard keys 80 may be disposed on the second protrusion 54 of the scope cap 20. The second plurality of hard keys 80 may include an input key 92 for inputting the bullet drop compensation data into the memory storage 24 and selecting the bullet drop compensation data from the memory storage 24, and a gun button 94 for scrolling through the plurality of memory storage 24 partitions to display the gun data. As noted above for the first plurality of hard keys 78 additional keys may be used, such as soft keys on a touch screen disposed on the visual display 22 or on a second visual display 22. Additionally, the second protrusion 54 may include other keys for controlling the memory storage 24, the visual display 22, or any other feature, such as the processor included in the alternative embodiment. Any of the first plurality of hard keys 78 may also be located on the second protrusion 54 and any of the second plurality of hard keys 80 may be located on the first protrusion 50.

As noted, the mounting end 44 of the scope cap 20 is adopted to be mounted to the first end 28 of the scope 26. The present invention may further include an adapter sleeve configured to permit the scope cap 20 to be mounted to a number of different scope having first ends of differing diameters or shapes. Such an adapter sleeve permits use of a single scope cap 20 with a large number of different scopes.

Obviously, many modifications and variations of the present invention are possible in light of the above teachings and may be practiced otherwise than as specifically described while within the scope of the appended claims. Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims

What is claimed is:

1. A device for recording and recalling bullet drop compensation data to a shooter for a firearm having a barrel axis and mountable on an end of a scope body containing an ocular lens and an objective lens, said device comprising:

a memory storage having at least one memory storage partition for storing the bullet drop compensation data, a visual display responsive to said memory storage for displaying the bullet drop compensation data, and a scope cap extending between a mounting end for being slidably disposed over the end of the scope body and a visual end presenting an opening for disposition over the ocular lens for viewing said memory storage and said visual display supported by said scope cap, wherein the memory storage and the visual display are disposed on the scope cap, and wherein the bullet drop compensation data is recalled to said visual display supported by said scope cap.

2. The device of claim 1 further including a first plurality of hard keys disposed on said scope cap for accessing bullet drop compensation data in said memory storage.

3. The device of claim 2 further including a second plurality of hard keys disposed on said scope cap for inputting bullet drop compensation data into said memory storage.

4. The device of claim 2 further including a bullet count mechanism in communication with said memory storage for counting the number of bullets discharged.

5. The device of claim 4 further including a power source supported by said scope cap in communication with said memory storage.

6. The device of claim 4 further including a protective lid attached to said scope cap for cover said opening and protecting the ocular lens.

7. The device of claim 6 further including a hinge pivotably attaching said protective lid to said scope cap for pivotal movement between a closed position covering said opening and an open position for viewing said ocular lens.

8. The device of claim 7 including a spring coacting with said hinge for alternatively holding said scope cap in said closed position and holding said scope cap in said open position for exposing said ocular lens.

9. The device of claim 7 wherein said protective lid further includes a flange protruding radially from said protective lid for applying a manual force to execute said pivotable movement of said protective lid.

10. The device of claim 6 wherein said scope cap further includes a lip extending about and axially from said visual end of said scope cap.

11. The device of claim 10 wherein said protective lid defines a groove for receiving said lip of said scope cap in said closed position of said protective lid.

12. The device of claim 1 wherein said memory storage further includes a plurality of memory storage partitions for storing the bullet drop compensation data for a plurality of different firearms.

13. A device for recording and recalling bullet drop compensation data to a shooter for a firearm having a barrel axis comprising;

a scope body of cylindrical shape disposed about a central axis and extending between a first end and a second end to present an outer wall and an inner wall, an ocular lens of circular shape concentric with said central axis and disposed in said scope body adjacent said first end for magnifying light, an objective lens of circular shape concentric with said central axis and disposed in said scope body adjacent said second end for transmitting light and viewing a selected target through said ocular lens, an elevation adjustment disposed on said outer wall of said scope body for adjusting the vertical angle between said central axis and the barrel axis for each distance to a selected target, a windage adjustment disposed on said outer wall of said scope body for adjusting the horizontal angle between said central axis and the barrel axis, a scope cap of generally cylindrical shape extending between a mounting end being circular and slidably attached over said cylindrical shape of said first end of said scope body and a visual end presenting an opening over said ocular lens for viewing said selected target, said visual end having a cylindrical shape and defining a top presenting a first protrusion extending radially and outwardly from said scope cap and a bottom presenting a second protrusion extending radially and outwardly from said scope cap, said visual end of said scope cap defining a lip of circular shape extending annularly about and axially from said visual end of said scope cap, a protective lid having an interior side defining a groove of circular shape for receiving and engaging said lip of said scope cap and an exterior side for shielding said ocular lens, said protective lid being pivotably attached to said scope cap for pivotal movement between a closed position covering said opening and protecting said ocular lens and an open position for viewing said ocular lens, a spring loaded hinge on said visual end pivotably attaching said protective lid to said scope cap for alternatively holding said scope cap in said closed position and holding said scope cap in said open position for exposing said ocular lens, a flange protruding radially from said protective lid for applying a manual force to execute said pivotable movement of said protective lid between said open position and said closed position, a memory storage supported by said scope cap having a plurality of memory storage partitions for storing the bullet drop compensation data to establish the vertical angle between said central axis and the barrel axis for each distance to a selected target, a bullet count mechanism supported by said scope cap for access by the shooter and in communication with said memory storage for counting the number of bullets discharged from the firearm, a visual display supported by said second protrusion of said scope cap for access by the shooter and responsive to said memory storage for displaying gun data and bullet count and distance to target and bullet drop compensation data, a backlight supported by said scope cap for illuminating said visual display, and a power source supported by said first protrusion of said scope cap in communication with said memory storage and said backlight, a first plurality of hard keys disposed on said first protrusion of said scope cap for accessing and recalling the bullet drop compensation information including a set of scroll keys for scrolling through the bullet drop compensation data, said first plurality of hard keys further including a backlight button for controlling said backlight and illuminating said visual display, said first plurality of hard keys further including a power button for controlling said power source, a second plurality of hard keys disposed on said second protrusion of said scope cap for inputting the bullet drop compensation data including an input key for inputting the bullet drop compensation data stored in said memory storage and selecting the bullet drop compensation data from said memory storage, and said second plurality of hard keys further including a gun button for scrolling through said plurality of memory storage partitions to display said gun data.

14. The device of claim 13 wherein said power source is a battery.

15. The device of claim 13 wherein said power source is a solar panel.

16. A scope cap assembly for mounting to a scope for use with a firearm, the scope cap assembly comprising a scope cap having a body portion adapted to be mounted to a first end of the scope, a first protrusion portion extending from the body portion and a second protrusion portion extending from the body portion opposite the first protrusion portion, said first protrusion portion having memory storage for recording, storing, and recalling the bullet drop compensation data, said second protrusion portion having a visual display responsive to said memory storage for displaying the bullet drop compensation data, and a protective lid mounted to said body portion of said scope cap for movement between an open and a closed position relative to a lens associated with said first end of the scope.

17. The scope cap assembly of claim 16 wherein said scope cap further includes a first set of hard keys for accessing the bullet drop compensation data in said memory storage and a second set of hard keys for inputting the bullet drop compensation data into said memory storage.

18. The scope cap assembly of claim 17 wherein said first set of hard keys are associated with said first protrusion portion of said scope cap and wherein said second set of hard keys are associated with said second protrusion portion of said scope cap.

19. The scope cap assembly of claim 16 wherein said scope cap further includes a power source in communication with said memory storage.

20. The scope cap assembly of claim 16 where said scope cap includes a first set of keys associated with said first protrusion portion and a second set of keys associated with said second protrusion wherein said first set of keys are operable for accessing the bullet drop compensation data storing in said memory storage and said second set of keys are operable for inputting the bullet drop compensation data into said memory storage.

* * * * *